US010808728B2

(12) United States Patent
Tokuyama

(10) Patent No.: US 10,808,728 B2
(45) Date of Patent: Oct. 20, 2020

(54) CENTRIFUGAL COMPRESSOR AND METHOD OF MODIFYING CENTRIFUGAL COMPRESSOR

(71) Applicant: MITSUBISHI HEAVY INDUSTRIES COMPRESSOR CORPORATION, Tokyo (JP)

(72) Inventor: Shinichiro Tokuyama, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 80 days.

(21) Appl. No.: 16/176,842

(22) Filed: Oct. 31, 2018

(65) Prior Publication Data

US 2019/0195243 A1 Jun. 27, 2019

(30) Foreign Application Priority Data

Dec. 27, 2017 (JP) ..... 2017-250439

(51) Int. Cl.

| | |
|---|---|
| ***F04D 29/70*** | (2006.01) |
| ***F04D 17/12*** | (2006.01) |
| ***F01D 25/00*** | (2006.01) |
| ***F04D 29/58*** | (2006.01) |

(52) U.S. Cl.

CPC ..... *F04D 29/705* (2013.01); *F01D 25/002* (2013.01); *F04D 17/122* (2013.01); *F04D 29/5846* (2013.01); *F05D 2210/12* (2013.01); *F05D 2230/80* (2013.01); *F05D 2260/212* (2013.01)

(58) Field of Classification Search

None

See application file for complete search history.

(56) References Cited

U.S. PATENT DOCUMENTS 2,697,328 A * 12/1954 Lee, II ..... F02C 9/00 60/39.281
2,747,367 A * 5/1956 Savin, Jr. ..... F02C 7/20 60/791

(Continued)

FOREIGN PATENT DOCUMENTS

| | | | |
|---|---|---|---|
| JP | H07-127600 | A | 5/1995 |
| JP | 2918773 | B2 | 7/1999 |
| JP | 2013-199941 | A | 10/2013 |

*Primary Examiner* — Michael Lebentritt

(74) *Attorney, Agent, or Firm* — Osha Liang LLP

(57) ABSTRACT

A multistage centrifugal compressor includes a casing, a rotor including a plurality of impellers, a diaphragm defining a gas flow path that includes a return flow path, and at least one liquid injection device configured to inject liquid into the gas flow path. The liquid injection device includes a liquid injection path, an internal path, a chamber, and a plurality of nozzles. The liquid injection path penetrates through the casing at a position corresponding to a return bend. The internal path receives a liquid supply pipe inserted from the liquid injection path through the return bend. The chamber is provided in the diaphragm along a circumferential direction and the liquid is introduced into the chamber through the internal path. The plurality of nozzles inject the liquid introduced into the chamber, to the gas flow path from different positions of the chamber in the circumferential direction.

17 Claims, 5 Drawing Sheets

(56) References Cited

U.S. PATENT DOCUMENTS

| | | | | | |
|---|---|---|---|---|---|
| 2,806,351 | A * | 9/1957 | Armer | F02C 7/22 | 60/790 |
| 3,795,117 | A * | 3/1974 | Moody, Jr. | F04C 29/042 | 62/197 |
| 4,057,371 | A * | 11/1977 | Pilarczyk | F01D 25/166 | 417/409 |
| 5,239,892 | A * | 8/1993 | Sakai | B23Q 1/28 | 108/139 |
| 5,755,554 | A * | 5/1998 | Ryall | F04D 3/00 | 415/199.4 |
| 5,988,987 | A * | 11/1999 | Wolcott | F04B 1/2042 | 417/269 |
| 6,287,088 | B1 * | 9/2001 | Nishimura | F04C 18/16 | 417/297 |
| 2003/0113207 | A1 * | 6/2003 | De Meo | F01D 11/00 | 415/199.5 |
| 2011/0280710 | A1 * | 11/2011 | Mariotti | F04D 27/023 | 415/65 |
| 2012/0049668 | A1 * | 3/2012 | Garriga | H02K 5/20 | 310/59 |
| 2016/0084110 | A1 * | 3/2016 | Giachetti | F01D 25/145 | 415/1 |
| 2019/0331134 | A1 * | 10/2019 | Kushner | F01D 9/045 | |

* cited by examiner

CENTRIFUGAL COMPRESSOR AND METHOD OF MODIFYING CENTRIFUGAL COMPRESSOR

BACKGROUND

Field

The present disclosure relates to a centrifugal compressor. More specifically, the present disclosure relates to a centrifugal compressor including a liquid injection device that injects liquid for cooling, cleaning, etc. of an inside of the centrifugal compressor, and relates to a method of modifying the centrifugal compressor.

Description of the Related Art

A centrifugal compressor that rotates impellers to compress the process gas is used to forcibly feed process gas in various plants. Temperature of the process gas is increased as a consequence of compression inside the centrifugal compressor. It is necessary to suppress generation of polymers through reaction of components in the gas due to the temperature increase of the process gas, and to clean a wall of a flow path in a cabin and the impellers when the generated polymers are adhered to the wall of the flow path and the like. Therefore, cleaning liquid or cooling liquid is injected into the flow path from nozzles that are provided in a pipe inserted from an outside into an inside of a casing of the centrifugal compressor.

Water is typically used as the cooling liquid, and oil is typically used as the cleaning liquid.

To spread the liquid injected into the flow path from an injection position to a wide range to achieve a cooling or cleaning effect, improvement relating to the injection position and control of the liquid injection has been performed.

In JP 2013-199941 A, a chamber communicating with a plurality of nozzles is provided along a circumferential direction of a diaphragm of a multistage centrifugal compressor in order to inject the cleaning liquid from the nozzles distributed in the circumferential direction. A rotor including a plurality of impellers and a diaphragm separating the impellers are accommodated inside the casing.

A liquid flow path for introducing the cleaning liquid into the above-described chamber is set between a return flow path on a front stage and a diffuser flow path on a rear stage while avoiding a position of a gas flow path in order to suppress influence on the flow of the process gas. The liquid flow path provided in the casing and the diaphragm in a radial direction at that position is changed in direction to an axis direction at a height of the chamber, and preferably penetrates through a return vane provided on a rear wall of the diaphragm in the axis direction and then reaches the chamber. The cleaning liquid introduced into the chamber through such a liquid flow path is injected into the gas flow path from the plurality of nozzles distributed in the circumferential direction of the chamber.

The centrifugal compressor disclosed in JP 2013-199941 A includes a liquid injection device that includes the above-described chamber provided in the diaphragm, and the liquid flow path provided in the casing and the diaphragm for introducing the cleaning liquid into the chamber.

To manufacture the centrifugal compressor including the liquid injection device disclosed in JP 2013-199941 A, it is necessary to provide the liquid flow path for introducing the cleaning liquid into the chamber, in the casing and the diaphragm, in addition to processing of the diaphragm and assembling of members to the diaphragm for providing the chamber. A supply pipe that is connected to a supply source of the cleaning liquid is inserted, along the radial direction, into the liquid flow path that opens outside the casing on outer peripheral side of the diaphragm. To support the supply pipe outside the casing, a support member is provided on the outer peripheral part of the casing.

To provide the liquid flow path in the casing and the diaphragm as disclosed in JP 2013-199941 A, a hole corresponding to the flow path extending along the radial direction is made in each of the casing and the diaphragm, and a hole corresponding to the flow path extending in the axis direction from a front end of the flow path to the chamber is made in the diaphragm.

Further, to dispose, on the outer peripheral part of the casing, a support member that supports the supply pipe inserted into the liquid flow path from the outside of the casing, a support member including a pipe that is continuous with the opening on the outer periphery of the casing corresponding to the flow path extending in the radial direction, is welded to the casing. The supply pipe is inserted into the liquid flow path part extending along the radial direction, through the support member provided on the casing.

It is not, however, realistic to make the hole in the casing and the diaphragm in the existing centrifugal compressor in a site, and to weld the support member to the casing as described above. It is extremely difficult to secure size precision of the hole in order to allow the supply pipe to pass through the hole without hindrance, and to secure welding quality and straightness of the support member.

Accordingly, an object of the present disclosure is to provide a centrifugal compressor including a liquid injection device that is applicable not only to a newly-manufactured centrifugal compressor but also to an existing centrifugal compressor, and a method of modifying the centrifugal compressor.

SUMMARY

A multistage centrifugal compressor according to the present disclosure compresses working gas, and includes a casing, a rotor including a rotary shaft and a plurality of impellers that are provided on the rotary shaft to compress the working gas, a diaphragm defining a gas flow path that includes a return flow path causing the working gas discharged from the impellers to be sucked into the impellers on corresponding next stages, and at least one liquid injection device configured to inject liquid into the gas flow path.

The liquid injection device includes a liquid injection path, an internal path, a chamber, and a plurality of injection portions. The liquid injection path penetrates through the casing at a position corresponding to a return bend that causes the working gas to flow into the return flow path. The internal path serves as a path through which the liquid passes, together with the liquid injection path and a pipe located at the return bend. The chamber is provided in the diaphragm along a circumferential direction and the liquid is introduced into the chamber through the internal path. The plurality of injection portions inject the liquid introduced into the chamber, to the gas flow path from different positions of the chamber in the circumferential direction.

In the centrifugal compressor according to the present disclosure, the injection portions preferably inject the liquid to a vicinity of a discharge port of the corresponding impeller.

In the centrifugal compressor according to the present disclosure, the internal path preferably linearly extends to the chamber.

In the centrifugal compressor according to the present disclosure, the pipe located at the return bend is preferably a liquid supply pipe that is inserted into the casing through the liquid injection path and is supplied with the liquid, and the liquid injection device preferably further includes a support part that supports the liquid supply pipe outside the casing.

In the centrifugal compressor according to the present disclosure, the support part preferably includes a support pipe that protrudes from an outer peripheral part of the casing and into which the liquid supply pipe is inserted, and a support flange provided on the support pipe. The support flange is preferably fixed to a liquid supply pipe flange provided on the liquid supply pipe.

In the centrifugal compressor according to the present disclosure, a liner that guides the liquid supply pipe to an inside of the support pipe is preferably disposed between the support flange and the liquid supply pipe flange.

In the centrifugal compressor according to the present disclosure, a space between an outer peripheral part of the liquid supply pipe and an inner wall of a member into which the liquid supply pipe is inserted is preferably sealed.

Further, the liquid supply pipe preferably extends to the chamber along the internal path, and a space between a front end part of the liquid supply pipe and a wall of the chamber surrounding the front end part is preferably sealed.

The centrifugal compressor according to the present disclosure preferably further includes a cover that covers, from a front side, an opening of a concave part provided on the diaphragm to define the chamber. At least one of the cover and the diaphragm to which the cover is fastened preferably includes a pressure relief groove that is recessed from a fastening surface between the cover and the diaphragm.

In the centrifugal compressor according to the present disclosure, a nozzle member provided with the injection portions is preferably detachably attached to a chamber member defining the chamber.

The centrifugal compressor according to the present disclosure further includes a water supply system through which water flows, an oil supply system through which oil flows, and a valve configured to switch the liquid to be introduced to the chamber through the liquid injection path and the internal path, to either the water supplied from the water supply system or the oil supplied from the oil supply system.

In the centrifugal compressor according to the present disclosure, the liquid injection device is preferably provided in at least one of a plurality of different positions where respective liquid injection paths are located in the circumferential direction in one stage.

Further, according to the present disclosure, provided is a method of modifying a multistage centrifugal compressor compressing working gas. The centrifugal compressor includes a casing, a rotor that includes a rotary shaft and a plurality of impellers, and a diaphragm that defines a gas flow path including a return flow path causing the working gas discharged from the impellers to be sucked into the impellers on corresponding next stages, and the casing includes, in advance, a liquid injection path penetrating through the casing at a position corresponding to a return bend that causes the working gas to flow into the return flow path. The method includes providing an internal path serving as a path through which liquid supplied to the liquid injection path passes, in the diaphragm at a position corresponding to the return bend, providing, in the diaphragm along a circumferential direction, a chamber that includes a plurality of injection portions injecting the liquid introduced through the internal path, to a vicinity of a discharge port of the corresponding impeller from different positions in the circumferential direction, accommodating, in the casing, the diaphragm provided with the internal path and the chamber, and inserting a liquid supply pipe that is supplied with the liquid, into the liquid injection path and the internal path from outside of the casing.

The method of modifying the centrifugal compressor according to the present disclosure preferably further includes fixing a support flange provided on a support part and a liquid supply pipe flange provided on the liquid supply pipe. The support part is preferably provided in the casing in advance, and preferably supports, outside the casing, the liquid supply pipe inserted into the liquid injection path.

In the method of modifying the centrifugal compressor according to the present disclosure, when the liquid supply pipe is inserted into the casing, the liquid supply pipe is preferably inserted into the support part while the liquid supply pipe is guided by a liner that is disposed between the support flange and the liquid supply pipe flange.

The method of modifying the centrifugal compressor according to the present disclosure preferably further includes forming a pressure relief groove that is recessed from a fastening surface between a cover and the diaphragm, on at least one of the cover and the diaphragm. The cover covers, from a front side, a concave part provided on the diaphragm, defines the chamber between the concave part and the cover, and is fastened to the diaphragm.

In the method of modifying the centrifugal compressor according to the present disclosure, a member provided with the injection portions is preferably detachably attached to a chamber member defining the chamber.

The liquid injection device according to the present disclosure does not require drill processing and welding with respect to the casing when the centrifugal compressor is modified because the liquid injection device is configured to include the existing liquid injection path in the casing.

Accordingly, it is possible to provide the liquid injection device in the existing centrifugal compressor only through modification of the structure inside the casing, without performing drill processing and welding on the casing installed in a site.

DETAILED DESCRIPTION OF EMBODIMENT

An embodiment of the present disclosure is described below with reference to accompanying drawings.

Figure 1:
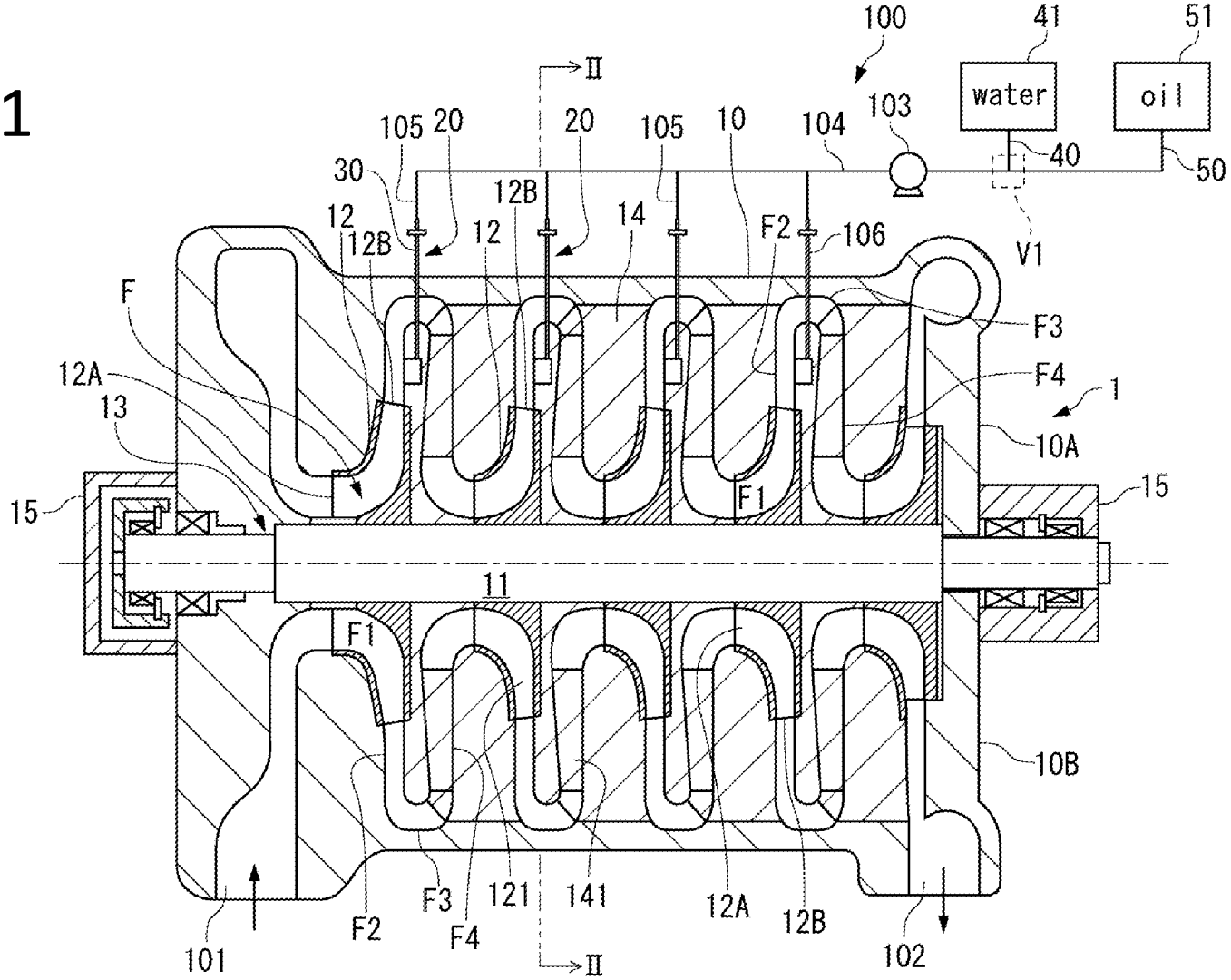
FIG. 1 is a vertical cross-sectional view illustrating a centrifugal compressor according to an embodiment of the present disclosure.

A multistage centrifugal compressor 1 illustrated in FIG. 1 rotates a plurality of impellers 12 provided on a rotary shaft 11 to compress process gas (working gas) in order to forcibly feed the process gas in various plants.

The centrifugal compressor 1 includes a casing 10, a rotor 13 that includes the rotary shaft 11 and the plurality of impellers 12, a diaphragm 14 that forms a gas flow path F including a return flow path F4, and a liquid injection device 20 that injects liquid into the gas flow path F for cleaning and cooling.

The casing 10 defines a cabin in which the rotor 13 and the diaphragm 14 are accommodated. The casing 10 includes appropriate members that are combined.

The casing 10 according to the present embodiment includes an upper half body 10A and a lower half body 10B that are assembled at a horizontal mating surface; however, the configuration is not limited thereto, and the casing 10 may include a cylindrical main body and a cover that closes an opening of the main body.

The casing 10 includes a suction portion 101 that sucks the process gas into the cabin, and a discharge portion 102 that discharges, to outside of the cabin, the process gas that is compressed by the impellers 12 in respective stages.

In the present specification, side provided with the suction portion 101 of the casing 10 is defined as "front", and side provided with the discharge portion 102 is defined as "rear".

The rotary shaft 11 is horizontally disposed, and both end parts thereof protruded from the casing 10 are supported by respective bearing devices 15. The whole of the rotor 13 including the rotary shaft 11 and the plurality of impellers 12 is rotated around an axis by an unillustrated power source connected to the rotary shaft 11.

Each of the impellers 12 includes a plurality of blades 121. Each of the impellers 12 compresses, by centrifugal force, the process gas that is sucked from a suction port 12A close to the rotary shaft 11 into a space between the blades 121, and discharges the compressed process gas from a discharge port 12B (between outer ends of adjacent blades 121) away from the rotary shaft 11.

The plurality of impellers 12 are disposed in an axis direction of the rotary shaft 11 with intervals.

Figure 3:
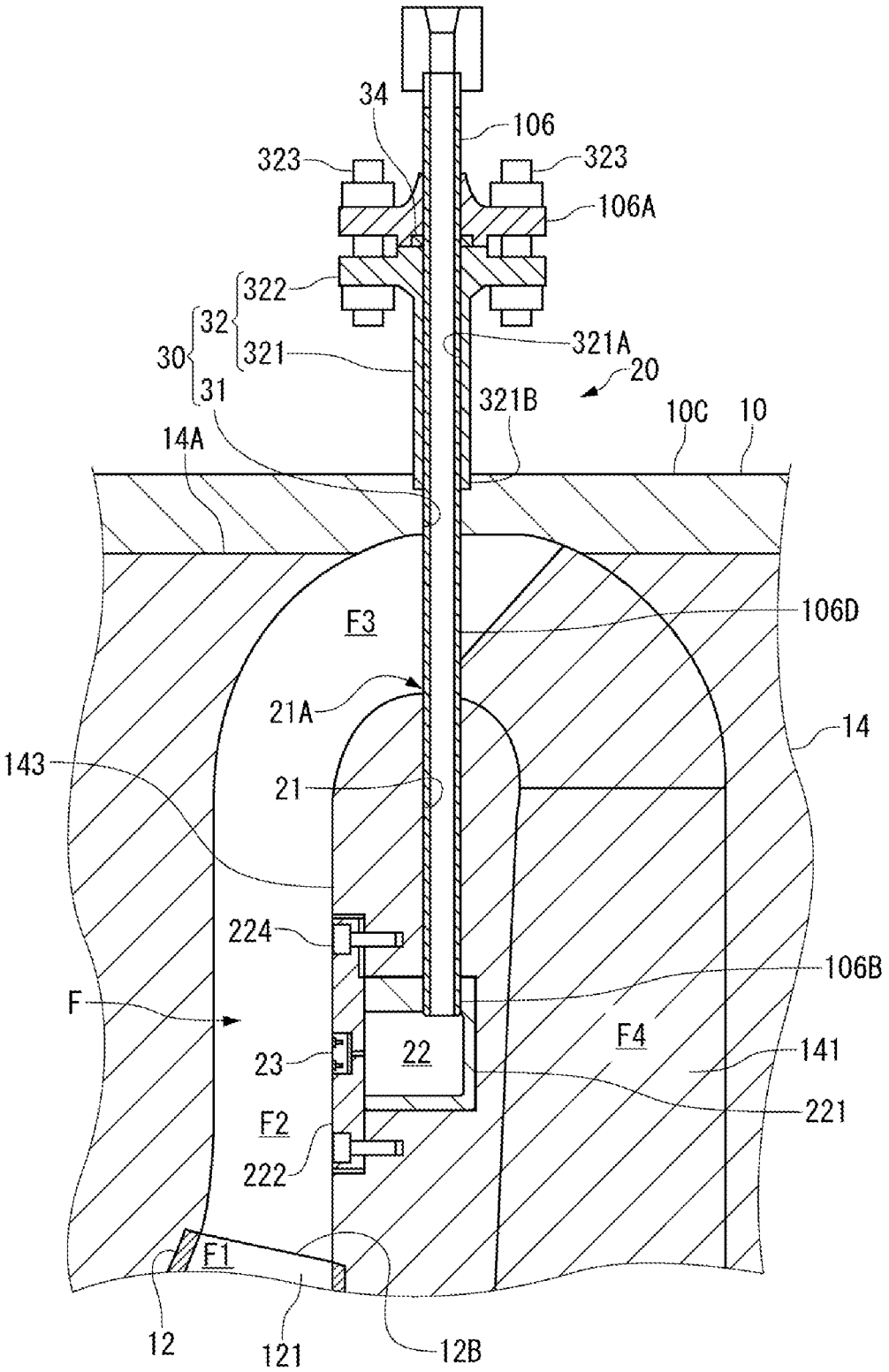
FIG. 3 is an enlarged view of a main part of FIG. 1 and illustrates a liquid injection device that injects liquid into a gas flow path.

As illustrated in FIG. 3, the gas flow path F includes an impeller flow path F1 between the blades 121 of each of the impellers 12, a diffuser flow path F2 that decelerates the process gas discharged from each of the impellers 12 to increase pressure, a return bend F3 that turns the flow of the process gas toward the rotary shaft 11 at an outer end 14A of the diaphragm 14, and the return flow path F4 that causes the process gas flowing in from the return bend F3 to be sucked into the impeller 12 on the next stage.

The return bend F3 is defined between the outer end 14A of the diaphragm 14 and an inner peripheral part of the casing 10. The return bend F3 corresponds to a region outside a straight line that is drawn in the axis line direction at a position of an outer end of a return vane 141, in a radial direction.

The diaphragm 14 is assembled to the impellers 12 and the casing 10 to define the gas flow path F. As illustrated by oblique lines in FIG. 1, the diaphragm 14 is provided, in each stage, over a range necessary for formation of the gas flow path F from a position of a rear wall of the diffuser flow path F2 to a position of a front wall of the diffuser flow path F2 on the next stage. The diaphragm 14 preferably includes a plurality of return vanes 141 each located at the corresponding return flow path F4.

Note that oblique lines provided for the diaphragm 14 in FIG. 1 and the like do not necessarily indicate a cross-section of the diaphragm 14.

The impellers 12 in the respective stages according to the present embodiment are all disposed in the same direction while the respective suction ports 12A are directed toward one end side of the rotary shaft 11, and have the same diameter.

The layout, the diameters, etc. of the impellers 12, however, are not limited to those in the present embodiment. For example, in a case where the suction portion is provided on each of both ends of the casing and the discharge portion is provided at a center of the casing, the impellers 12 may be disposed front/rear symmetrically with respect to the center.

In the cabin of the centrifugal compressor 1, components in the gas are reacted to generate polymers due to temperature increase of the process gas resulting from compression, and the generated polymers are adhered to a wall of the gas flow path F, the impellers 12, and the like in some cases. To avoid performance deterioration, occurrence of vibration, etc. of the centrifugal compressor 1 in such a case, it is necessary to cool the process gas and to clean the wall of the flow path and the like adhered with the polymers, in a timely manner. Therefore, liquid is injected into the gas flow path F by the liquid injection device 20 (injection). The liquid injection by the liquid injection device 20 is periodically performed, is timely performed while monitoring the performance of the centrifugal compressor 1, or is constantly performed during operation of the centrifugal compressor 1.

For purpose of suppressing generation of the polymers, water is suitable, and it is possible to reduce the temperature of the process gas by latent heat accompanying vaporization of water. For purpose of removing the polymers through cleaning, oil is suitable, and it is possible to separate the polymers from the wall of the gas flow path F, the impellers 12, and the like by action of the oil.

As illustrated in FIG. 1, the centrifugal compressor 1 according to the present embodiment includes the liquid injection device 20 in each of the stages.

Figure 2:
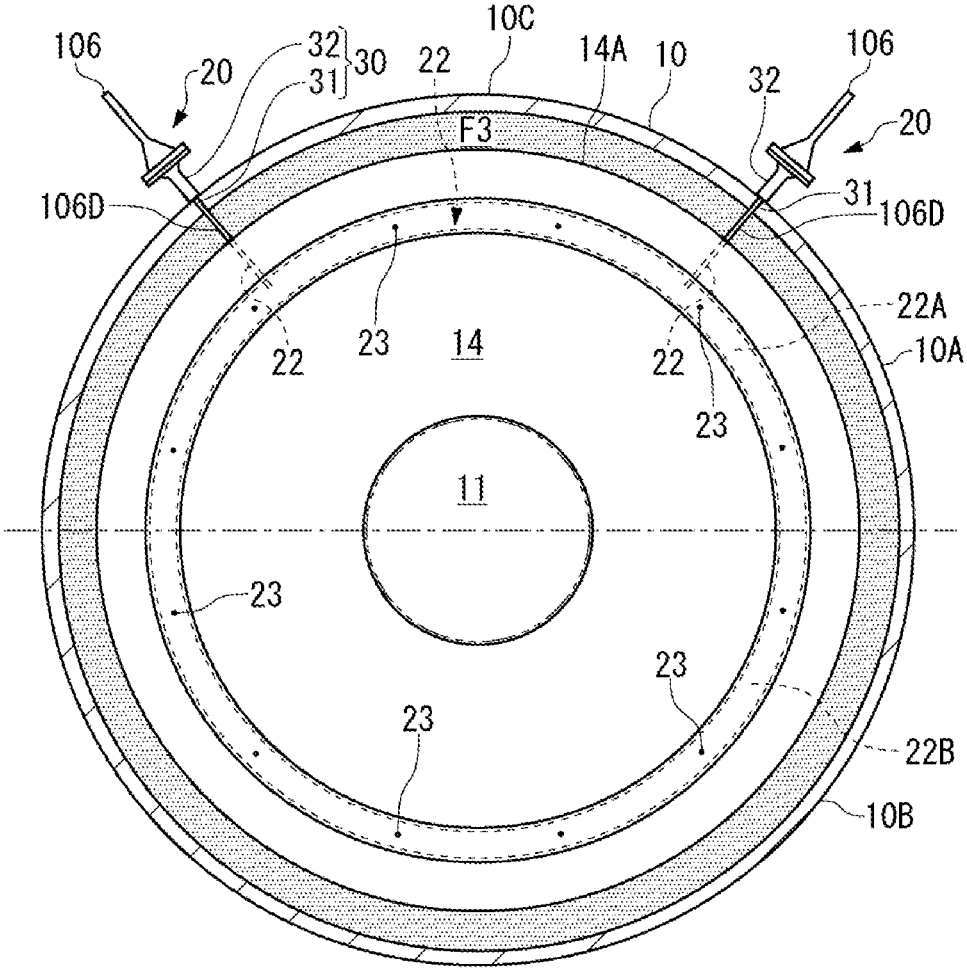
FIG. 2 is a cross-sectional schematic view taken along a line II-II of FIG. 1.

As illustrated in FIG. 2, the liquid injection device 20 is provided at each of two different positions in a circumferential direction on upper side of the centrifugal compressor 1. The liquid injection device 20 uses a liquid injection structure 30 and is provided at the corresponding liquid injection structure 30. The liquid injection structure 30 includes a liquid injection path 31 that penetrates through the casing 10 for the liquid injection into the return bend F3.

In a case where the liquid injection structure 30 is provided on lower side of the centrifugal compressor 1, the liquid injection device 20 may be provided on the lower side of the centrifugal compressor 1.

The liquid injection device 20 may be provided horizontally at a position of a boundary between the upper side and the lower side illustrated by an alternate long and short dash line in FIG. 2.

The liquid injection device 20 may be provided on each of the upper side and the lower side of the centrifugal compressor 1, or may be provided on one of the upper side and the lower side.

Further, the liquid injection device 20 may be provided at one position on each of the upper side and the lower side of the centrifugal compressor 1, or may be provided at one position only on the upper side or only on the lower side.

Even when two liquid injection structures 30 are provided as illustrated in FIG. 2, only one liquid injection structure 30 may be used for the liquid injection device 20, and the remaining liquid injection structure 30 may not be necessarily used. In this case, the remaining liquid injection structure 30 may be used for the liquid injection to the return bend F3, or may be covered and closed by a member.

The position where the liquid injection device 20 is provided may be appropriately selected in consideration of interference between the member inside/outside the casing 10 and the member of the liquid injection device 20, maintenance easiness of the liquid injection device 20, and the like.

Note that the stage and the position in the circumferential direction where the liquid injection device 20 is disposed, or the number of the liquid injection devices 20 in each of the stages may be appropriately determined based on the temperature of the process gas, an adhesion state of the polymers, the state of performance deterioration caused by adhesion of the polymers, and the like in each of the stages.

Each liquid injection device 20 provided in the centrifugal compressor 1 may inject water into the gas flow path F or may inject oil into the gas flow path F. Further, water may be injected from any one of two liquid injection devices 20 in one stage illustrated in FIG. 2, and oil may be injected from the other liquid injection device 20.

A supply system that supplies predetermined liquid from a liquid supply source to the liquid injection device 20 may be appropriately configured. FIG. 1 illustrates an example of a liquid supply system 100 that includes a water supply system 40 connected to a water supply source 41 and an oil supply system 50 connected to an oil supply source 51. The liquid supply system 100 includes a valve V1 and a pump 103. The valve V1 switches the liquid to be supplied to a liquid supply pipe 106 provided on the liquid injection device 20, to the water from the water supply system 40 or to the oil from the oil supply system 50. The pump 103 forcibly feeds the liquid. In the liquid supply system 100, a piping 104 including the pump 103 and a piping 105 that is branched from the piping 104 to the liquid injection device 20 in each of the stages are common to the water supply system 40 and the oil supply system 50.

The valve V1 is driven based on a control signal provided from an unillustrated controller. In place of the valve V1, a valve that opens or closes a flow path of the water supply system 40 and a valve that opens or closes a flow path of the oil supply system 50 may be provided.

[Liquid Injection Device]

The configuration of the liquid injection device 20 that injects the predetermined liquid into the gas flow path F is described below.

The liquid injection device 20 is mainly characterized by including the corresponding liquid injection structure 30 for the return bend F3. The liquid injection structure 30 is provided in the casing 10 of the centrifugal compressor 1 in advance.

As illustrated in FIG. 1 to FIG. 3, the liquid injection device 20 includes the liquid injection structure 30 that includes the liquid injection path 31 and a support part 32, an internal path 21 provided in the diaphragm 14, a chamber 22 provided in the diaphragm 14 along a circumferential direction, and a plurality of nozzles 23 (injection portions) that communicate with the chamber 22.

The liquid injection device 20 guides the liquid from the return bend F3 to the chamber 22 through the internal path 21 of the diaphragm 14 while using the corresponding liquid injection structure 30 corresponding to the return bend F3, and injects the liquid from the nozzles 23 distributed in the circumferential direction of the chamber 22 toward the vicinity of the discharge port 12B of the corresponding impeller 12. The process gas is cooled by the liquid injected into the vicinity of the discharge port 12B of the impeller 12, which makes it possible to suppress generation of the polymers at the vicinity of the discharge port 12B of the impeller 12 from which the high-temperature compressed gas is discharged, and to suppress adhesion of the polymers to the impeller 12, the wall of the flow path, and the like.

In addition, the liquid injected from the nozzles 23 is diffused toward the gas flow path F in the circumferential direction, the return bend F3, and the return flow path F4 by the flow of the process gas discharged from the impeller 12. This makes it possible to achieve cooling and cleaning effects by the liquid injection over a wide range.

(Liquid Injection Structure)

The liquid injection structure 30 includes the liquid injection path 31 that penetrates through the casing 10 at a position corresponding to the return bend F3, and the support part 32 that supports, outside the casing 10, the liquid supply pipe 106 that is inserted into the casing 10 through the liquid injection path 31.

As illustrated in FIG. 2 and FIG. 3, the liquid injection path 31 penetrates through the casing 10 along the radial direction of the casing 10 at the position of the return bend F3.

It is sufficient for the liquid injection structure 30 to include at least the liquid injection path 31.

As illustrated in FIG. 3, the support part 32 includes a support pipe 321 into which the liquid supply pipe 106 is inserted, and a support flange 322 provided on the support pipe 321.

The support pipe 321 protrudes from an outer peripheral part 10C of the casing 10 toward the outside in the radial direction as illustrated in FIG. 3. A base end part 321B of the support pipe 321 is fixed to the outer peripheral part 10C of the casing 10 by welding or the like.

The support pipe 321 includes a cylindrical space that is continuous with an opening of the liquid injection path 31 on the outer peripheral part 10C of the casing 10.

The support flange 322 is provided at a front end part of the support pipe 321. The liquid supply pipe 106 to which the liquid is supplied through the liquid supply system 100 (FIG. 1) is inserted into an internal space 321A of the support pipe 321 from the support flange 322 side, and is inserted into the casing 10 through the liquid injection path 31 that is continuous with the internal space 321A.

The support flange 322 is fastened by a flange 106A provided on the liquid supply pipe 106 and a bolt 323. A gasket 34 that contains a rubber elastic material is disposed to seal a space between the support flange 322 and the flange 106A.

The centrifugal compressor 1 generally includes the liquid injection structure 30 that includes the liquid injection path 31 for the return bend F3 and the support part 32 supporting the liquid supply pipe 106, except for a special centrifugal compressor. Accordingly, in a case where a centrifugal compressor including the liquid injection device 20 is realized by modification to provide the liquid injection device 20 to an existing centrifugal compressor, the liquid injection structure 30 is provided in the casing 10 in advance, before the modification.

Although the positions and the number of the liquid injection structures 30 are changed depending on the performance of the centrifugal compressor 1, the components of the process gas, and the like, it is possible to select the appropriate liquid injection structure 30 to configure the liquid injection device 20.

(Liquid Supply Pipe)

The liquid supply pipe 106 is inserted inside the casing 10 from the outside of the casing 10 through the liquid injection structure 30. As illustrated in FIG. 2 and FIG. 3, the liquid supply pipe 106 passes through the return bend F3 that is a gap between the casing 10 and the diaphragm 14 (see 106D in FIG. 3).

Components other than the existing liquid injection structure 30 are described below.

(Internal Path)

As illustrated in FIG. 2 and FIG. 3, the internal path 21 provided in the diaphragm 14 extends to the chamber 22 along the radial direction of the diaphragm 14 at the position corresponding to the return bend F3. The internal path 21 preferably linearly extends from the outer end 14A of the diaphragm 14 to the position of the chamber 22.

The internal path 21 is located on the same straight line as the internal space 321A of the support part 32 and the liquid injection path 31. The liquid supply pipe 106 inserted into the internal space 321A from the outside of the casing 10 is inserted into the internal path 21 through the liquid injection path 31 and the return bend F3. Further, the liquid supplied to the liquid supply pipe 106 is introduced into the chamber 22.

The internal path 21 forms a path through which the liquid passes, together with the liquid injection path 31 and the liquid supply pipe 106 located at the return bend.

(Chamber)

As illustrated in FIG. 2 and FIG. 3, the chamber 22 is provided in a region between the diffuser flow path F2 and the return flow path F4 on the downstream of the diffuser flow path F2 in the diaphragm 14 over the entire circumference of the diaphragm 14. The liquid pushed into the chamber 22 through the liquid supply pipe 106 is injected from the nozzles 23 toward the vicinity of the discharge port 12B of the impeller 12. The liquid injection device 20 includes the chamber 22 extending along the circumferential direction, thereby diffusing the liquid supplied from the specific place in the circumferential direction through the liquid supply pipe 106, in the circumferential direction in the chamber 22, and injecting the liquid from the nozzles 23 at the positions distributed in the circumferential direction.

Since the casing 10 according to the present embodiment is divided into the upper half body 10A and the lower half body 10B, the diaphragm 14 and the chamber 22 are each also divided into two bodies at the position illustrated by the alternate long and short dash line in FIG. 2, as with the casing 10. An upper chamber 22A and a lower chamber 22B communicate with each other. Accordingly, the liquid introduced into the upper chamber 22A by the liquid injection device 20 provided on the upper side of the centrifugal compressor 1 is also introduced into the lower chamber 22B.

To uniformly achieve the cooling effect and the cleaning effect by the liquid injection over the entire circumference, the chamber 22 is preferably provided over the entire circumference of the diaphragm 14. To avoid interference with other members, however, the chamber 22 may be provided in a predetermined limited region in the circumferential direction.

The chamber 22 is not necessarily continuous over the entire circumference. For example, the chamber 22 may be divided into four chamber spaces in the circumferential direction. If the liquid injection device 20 is provided corresponding to each of the four chamber spaces independent of one another, the liquid is individually introducible into the chamber spaces. Accordingly, for example, it becomes possible to perform control to sequentially introduce the liquid into the chamber spaces. Limitedly introducing the liquid into a part of the chamber spaces makes it possible to achieve the cleaning effect and the cooling effect while suppressing performance deterioration during the liquid injection processing.

The chamber 22 (FIG. 2 to FIG. 4B) according to the present embodiment is a space defined inside a box 221 extending along the circumferential direction and a cover plate 222 that covers the box 221 from the front side and is assembled to the diaphragm 14.

The box 221 is accommodated in a groove 142 that is provided in the diaphragm 14 at a position close to the discharge port 12B of the impeller 12. The groove 142 is provided in an annular shape along the circumferential direction.

The cover plate 222 is disposed on the same plane as a front wall 143 of the diaphragm 14 facing the diffuser flow path F2, and covers an opening of the box 221 (concave part).

The cover plate 222 is fixed to the diaphragm 14 by bolts 224 at a plurality of positions in the circumferential direction. The cover plate 222 is fastened to the diaphragm 14 by the bolts 224 that are disposed on outer peripheral side and inner peripheral side of the box 221. Thus, the cover plate 222, the box 221, and the diaphragm 14 are assembled to one another.

Figure 4A:
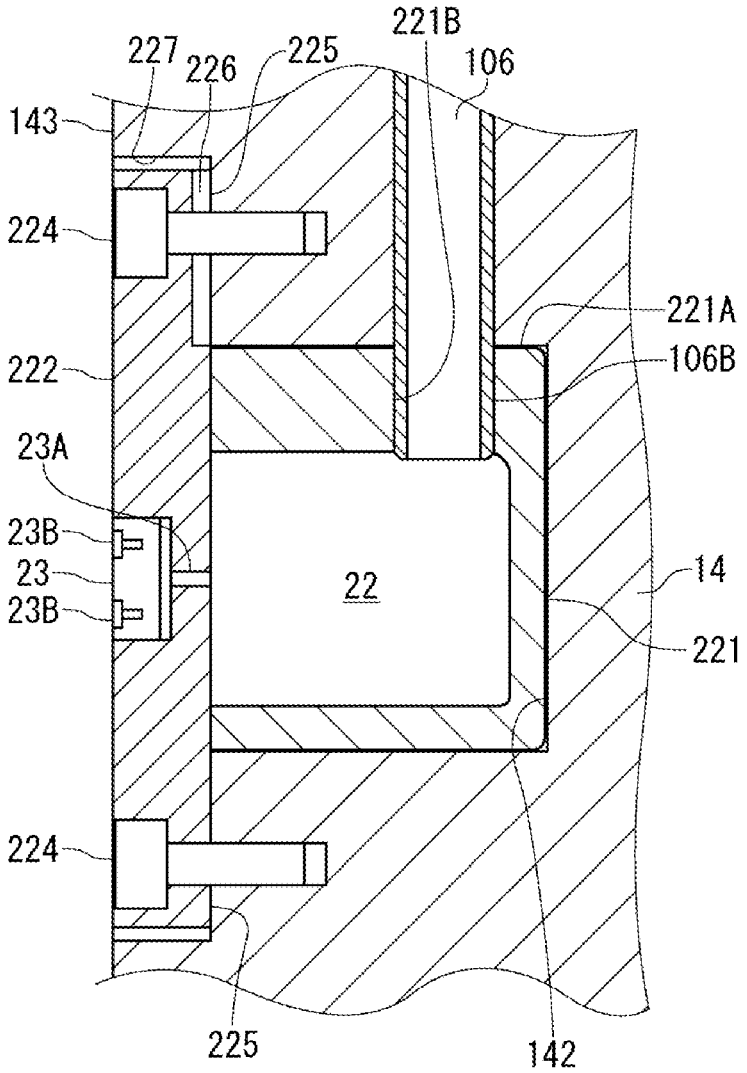
FIG. 4A is a partial enlarged view of FIG. 3.

As illustrated in FIG. 4A, the above-described liquid supply pipe 106 extends to the chamber 22 along the internal path 21. A front end part 106B of the liquid supply pipe 106 is inserted into a through hole 221B of an outer peripheral wall 221A of the box 221. A space between the front end part 106B of the liquid supply pipe 106 and the box 221 surrounding the front end part 106B is sealed.

The space between the front end part 106B of the liquid supply pipe 106 and the box 221 may be sealed by direct contact between a metal surface of the front end part 106B and a metal surface of the box 221, or may be sealed by a rubber seal or a compound for sealing that is interposed between the front end part 106B and the box 221.

If the space between an outer peripheral part of the liquid supply pipe 106 and an inner wall of the internal path 21 of the diaphragm 14 through which the liquid supply pipe 106 is inserted, and the space between the outer peripheral part of the liquid supply pipe 106 and an inner wall of the hole of the outer peripheral wall 221A of the box 221 are not sealed, in a case where the liquid is leaked from the inside of the chamber 22 to the outside of the chamber 22, the liquid may be leaked to the return bend F3 through an opening 21A of the internal path 21 (FIG. 3) or to the gas flow path F through a pressure relief groove 226 described later. To cut off the liquid leakage path from the chamber 22 and to supply a sufficient amount of liquid to the vicinity of the discharge port 12B of the impeller 12, the space between the outer peripheral part of the liquid supply pipe 106 and the inner wall of the internal path 21 and the space between the outer peripheral part of the liquid supply pipe 106 and the inner wall of the hole of the outer peripheral wall 221A are preferably sealed.

Unlike the present embodiment, if the space between the outer peripheral part of the liquid supply pipe 106 and the inner wall of the internal path 21 is sealed on the outside of the diaphragm 14 in the radial direction relative to the front end part 106B of the liquid supply pipe 106, the configuration is allowed because the configuration can prevent the liquid leakage from the opening 21A of the internal path 21.

In the present embodiment, the liquid supply pipe 106 extends to the chamber 22 along the internal path 21, and the space between the front end part 106B of the liquid supply pipe 106 and the inner wall of the hole of the outer peripheral wall 221A of the box 221 surrounding the front end part 106B is sealed. The configuration is more preferable because the liquid leakage from the opening 21A of the internal path 21 and the liquid leakage from the pressure relief groove 226 are both prevented.

Assuming that the liquid is leaked from the inside of the chamber 22 to the outside of the chamber 22, the pressure of the process gas flowing through the return bend F3 that communicates with the internal path 21 acts on the chamber 22 inside the box 221, which may increase the pressure of the chamber 22. To release the excessive pressure at this time to the outside of the chamber 22 (gas flow path F), the pressure relief groove 226 that is recessed from a fastening surface 225 between the diaphragm 14 and the cover plate 222 is provided.

The pressure relief groove 226 is provided along the radial direction of the cover plate 222. The relief groove 226 is preferably provided at each of a plurality of positions with intervals in the circumferential direction of the cover plate 222. The pressure relief groove 226 may be provided on the fastening surface 225 that is located on the inner peripheral side of the cover plate 222.

When the pressure of the chamber 22 is increased, the pressure is released to the gas flow path F (diffuser flow path F2) through the pressure relief groove 226 located on the fastening surface 225 and a gap 227 between the cover plate 222 and the diaphragm 14. This makes it possible to prevent, for example, the bolts 224 from being drawn out or the members (cover plate 222 and box 221) defining the chamber 22 from being broken.

The pressure relief groove 226 according to the present embodiment is provided in the cover plate 222; however, may be provided on the diaphragm 14. Alternatively, the pressure relief groove 226 may be provided on each of the cover plate 222 and the diaphragm 14.

Note that the chamber 22 does not necessarily include the box 221. For example, the similar chamber 22 may be configured of a groove 142 that is provided on the diaphragm 14 and the cover plate 222 that covers an opening of the groove 142 and is assembled to the diaphragm 14.

(Nozzle (Injection Portion))

The nozzles 23 provided on the cover plate 222 inject the pressurized liquid inside the chamber 22 to the discharge port 12B of the impeller 12.

As illustrated in FIG. 2, the nozzles 23 are distributed in the circumferential direction of the chamber 22, and the liquid is injected by the nozzles 23 from different positions in the circumferential direction to the vicinity of the discharge port 12B of the impeller 12. The liquid injected from the nozzles 23 is conveyed and diffused by the flow of the process gas discharged from the impeller 12.

Each of the nozzles 23 according to the present embodiment injects, from a plurality of injection ports 23B, the liquid flowing in from the chamber 22 through corresponding fine hole 23A. Each of the nozzles 23 may include an unillustrated rectification part rectifying the liquid.

Injection holes penetrating through the cover plate 222 in a thickness direction may be used in place of the nozzles 23 as long as the injection holes allows for injection of the liquid inside the chamber 22 as liquid droplets.

Figure 4B:
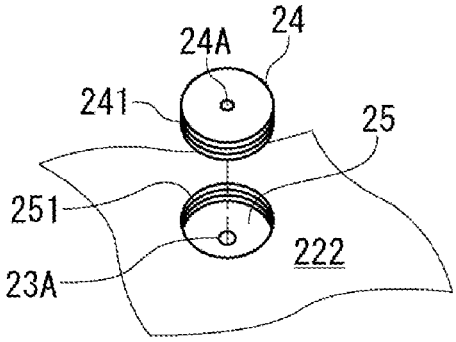
FIG. 4B is a diagram schematically illustrates a nozzle member that is detachably attached to a chamber member.

FIG. 4B illustrates a nozzle member 24 that is detachably attached, by a screw 241, to the cover plate 222 defining the chamber 22.

The screw 241 provided on an outer peripheral part of the nozzle member 24 engages with a female screw 251 of a screw hole 25 in the cover plate 222, which causes the nozzle member 24 to be fixed to the cover plate 222.

The nozzle member 24 includes an injection hole 24A as the injection portion that penetrates through the nozzle member 24. In a state where the nozzle member 24 is attached to the cover plate 222, the liquid inside the chamber 22 enters the injection hole 24A through the fine hole 23A and is injected to the vicinity of the discharge port 12B of the impeller 12 from the injection hole 24A.

A diameter of each of liquid droplets, an injection range of the liquid droplets, a diffusion state from the injection range, and the like are changed depending on a diameter of the injection hole 24A of the nozzle member 24. Accordingly, replacing the nozzle member 24 to the nozzle member 24 different in diameter of the injection hole 24A makes it possible to inject the liquid from the injection hole 24A having an appropriate diameter without changing the diameter of the fine hole 23A of the cover plate 222. For example, the fine hole 23A is preferably formed to have the maximum diameter within an appropriate range, and a plurality of nozzle members 24 including the injection holes 24A that are each smaller in diameter than the fine hole 23A and are different in diameter from one another are preferably prepared.

In addition, the nozzle member 24 may be replaced with the nozzle member 24 different in an opening shape of the injection hole 24A, or the nozzle member 24 including a rectification part and the like.

The centrifugal compressor 1 including the liquid injection device 20 described above is applicable to an existing centrifugal compressor.

A method of modifying the existing centrifugal compressor to the centrifugal compressor 1 including the liquid injection device 20 is described below. Such modification requires only modification of the diaphragm 14 inside the casing 10 without requiring modification of the casing 10 while the casing 10 is placed at a site such as a plant. This allows for application of the liquid injection device 20 to the existing centrifugal compressor.

If it is necessary to perform drill processing or welding on the casing 10 in order to apply the liquid injection device 20 to the existing centrifugal compressor, securement of hole precision, straightness, and the like at the site becomes a problem. Accordingly, it is difficult to apply the liquid injection device 20 to the existing centrifugal compressor.

The liquid injection device 20, however, uses the existing liquid injection structure 30 that has been already provided in the casing 10 at the time of the modification, as described above. Therefore, the drill processing and the welding with respect to the casing 10 are unnecessary for the modification.

The method of modifying the existing centrifugal compressor according to the present embodiment is performed by, for example, the following procedure.

The following steps (1) and (2) are performed on the diaphragm 14 that is taken out from the casing 10 installed in the site, under sufficient quality control.

(1) The internal path 21 that serves as a path through which the liquid supplied to the liquid injection path 31 passes is formed, by drill processing, at a position of the diaphragm 14 corresponding to the return bend F3 (internal path forming step). Since the whole of the internal path 21 has a linear shape, the internal path 21 is easily formable by one drill processing.

(2) Next, the chamber 22 is provided in the diaphragm 14 along the circumferential direction (chamber providing step). More specifically, the groove 142 is formed in the diaphragm 14, and the box 221 is disposed in the groove 142. Thereafter, the cover plate 222 attached with the plurality of nozzles 23 is fastened to the diaphragm 14. In a case where the nozzle member 24 is used as the injection portion, the nozzle member 24 including the injection hole 24A with an appropriate diameter is attached to the screw hole 25 in the cover plate 222.

Note that, in a case where the existing centrifugal compressor includes a structure similar to the structure of the chamber 22, the existing structure is usable.

Before installation of the chamber 22, the pressure relief groove 226 is preferably formed in the cover plate 222.

(3) The diaphragm 14 provided with the internal path 21 and the chamber 22 is carried in the site and is accommodated in the casing 10 (diaphragm accommodating step).

(4) The liquid supply pipe 106 is inserted, from the outside of the casing 10, into the internal space 321A of the support part 32, the liquid injection path 31, the return bend F3, and the internal path 21 (liquid supply pipe inserting step).

Figure 5:
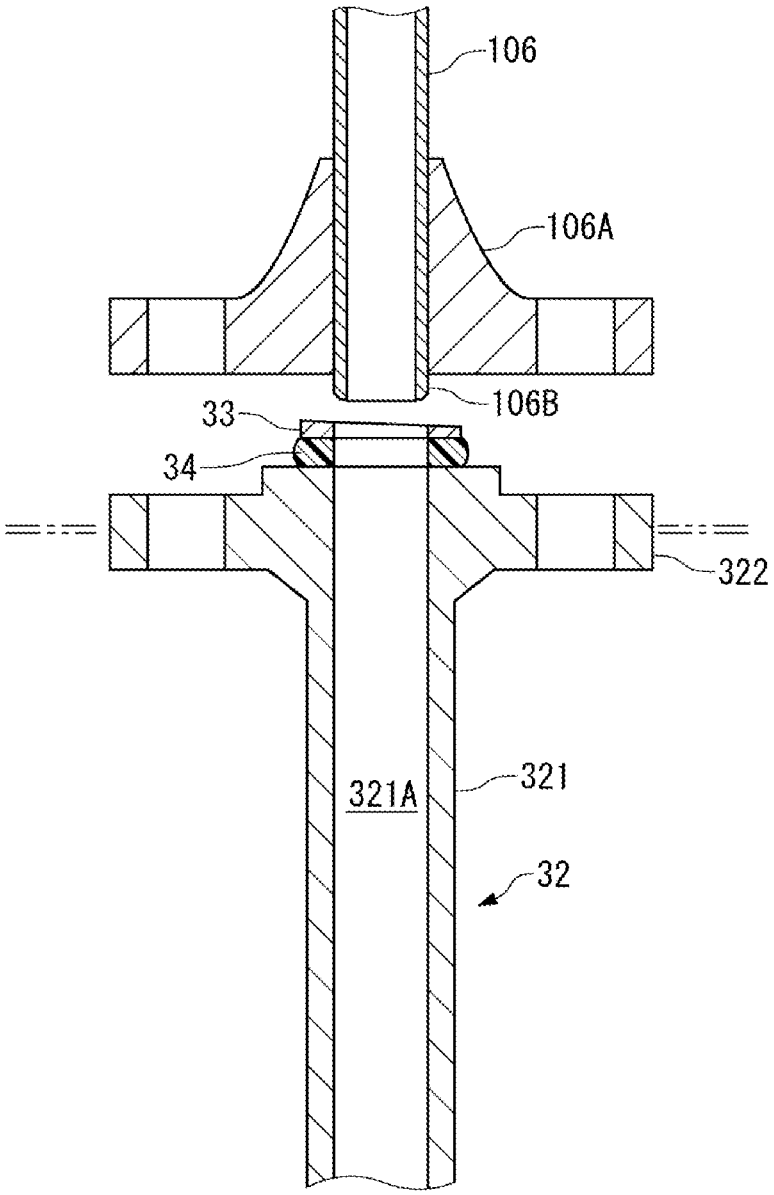
FIG. 5 is a diagram to explain a liner that is disposed between a support flange and a liquid supply pipe flange.

At this time, as illustrated in FIG. 5, the existing support flange 322 may be deformed with respect to the horizontal direction illustrated by an alternate long and short dash line, and may be inclined from a right-angled attitude relative to the support pipe 321. In such a case, an inclined liner 33 that corresponds to the inclination of the support flange 322 is preferably used. The inclined liner 33 is different in thickness between one side and the other side in the diameter direction. When the inclined liner 33 is disposed in an appropriate direction on the gasket 34 that is disposed on the support flange 322, the liquid supply pipe 106 can be inserted into the casing 10 while the inclined liner 33 guides the liquid supply pipe 106 to the internal space 321A of the support part 32.

(5) After the liquid supply pipe 106 is inserted to the chamber 22, the flange 106A and the support flange 322 are fixed by the bolt 323 (liquid supply pipe fixing step).

When the centrifugal compressor 1 including the liquid injection device 20 is newly manufactured, the drill processing and the welding are performable under sufficient quality control. Therefore, it is possible to configure the liquid injection device 20 while sufficiently securing hole precision of the liquid injection path 31, straightness of the support part 32, and the like, and to ship the centrifugal compressor 1 to the site such as a plant.

Other than the above, the configurations described in the above-described embodiment may be selected or appropriately modified without departing from the scope of the present disclosure.

What is claimed is:

1. A multistage centrifugal compressor that compresses working gas, the centrifugal compressor comprising:

a casing;

a rotor including a rotary shaft and a plurality of impellers that are provided on the rotary shaft to compress the working gas;

a diaphragm defining a gas flow path that includes a return flow path causing the working gas discharged from the impellers to be sucked into the impellers on corresponding next stages; and at least one liquid injection device configured to inject liquid into the gas flow path, wherein the liquid injection device includes a liquid injection path, an internal path, a chamber, and a plurality of injection portions, the liquid injection path penetrating through the casing at a position corresponding to a return bend that causes the working gas to flow into the return flow path, the internal path serving as a path through which the liquid passes, together with the liquid injection path and a pipe located at the return bend, the chamber being provided in the diaphragm along a circumferential direction, the liquid being introduced into the chamber through the internal path, and the plurality of injection portions injecting the liquid introduced into the chamber, to the gas flow path from different positions of the chamber in the circumferential direction.

2. The centrifugal compressor according to claim 1, wherein the injection portions inject the liquid to a vicinity of a discharge port of the corresponding impeller.

3. The centrifugal compressor according to claim 1, wherein the internal path linearly extends to the chamber.

4. The centrifugal compressor according to claim 1, wherein the pipe located at the return bend is a liquid supply pipe that is inserted into the casing through the liquid injection path and is supplied with the liquid, and the liquid injection device further includes a support part that supports the liquid supply pipe outside the casing.

5. The centrifugal compressor according to claim 4, wherein the support part includes a support pipe that protrudes from an outer peripheral part of the casing and into which the liquid supply pipe is inserted, and a support flange provided on the support pipe, and the support flange is fixed to a liquid supply pipe flange provided on the liquid supply pipe.

6. The centrifugal compressor according to claim 5, wherein a liner that guides the liquid supply pipe to an inside of the support pipe is disposed between the support flange and the liquid supply pipe flange.

7. The centrifugal compressor according to claim 4, wherein a space between an outer peripheral part of the liquid supply pipe and an inner wall of a member into which the liquid supply pipe is inserted is sealed.

8. The centrifugal compressor according to claim 7, wherein the liquid supply pipe extends to the chamber along the internal path, and a space between a front end part of the liquid supply pipe and a wall of the chamber surrounding the front end part is sealed.

9. The centrifugal compressor according to claim 1, further comprising a cover that covers, from a front side, an opening of a concave part provided on the diaphragm to define the chamber, wherein at least one of the cover and the diaphragm to which the cover is fastened includes a pressure relief groove that is recessed from a fastening surface between the cover and the diaphragm.

10. The centrifugal compressor according to claim 1, wherein a nozzle member provided with the injection portions is detachably attached to a chamber member defining the chamber.

11. The centrifugal compressor according to claim 1, further comprising:

a water supply system through which water flows;

an oil supply system through which oil flows; and a valve configured to switch the liquid to be introduced to the chamber through the liquid injection path and the internal path, to either the water supplied from the water supply system or the oil supplied from the oil supply system.

12. The centrifugal compressor according to claim 1, wherein the liquid injection device is provided in at least one of a plurality of different positions where respective liquid injection paths are located in the circumferential direction in one stage.

13. A method of modifying a multistage centrifugal compressor compressing working gas, the centrifugal compressor including a casing, a rotor that includes a rotary shaft and a plurality of impellers, and a diaphragm that defines a gas flow path including a return flow path causing the working gas discharged from the impellers to be sucked into the impellers on corresponding next stages, the casing including, in advance, a liquid injection path penetrating through the casing at a position corresponding to a return bend that causes the working gas to flow into the return flow path, the method comprising:

providing an internal path serving as a path through which liquid supplied to the liquid injection path passes, in the diaphragm at a position corresponding to the return bend;

providing, in the diaphragm along a circumferential direction, a chamber that includes a plurality of injection portions injecting the liquid introduced through the internal path, to a vicinity of a discharge port of the corresponding impeller from different positions in the circumferential direction;

accommodating, in the casing, the diaphragm provided with the internal path and the chamber; and inserting a liquid supply pipe that is supplied with the liquid, into the liquid injection path and the internal path from outside of the casing.

14. The method of modifying the centrifugal compressor according to claim 13, further comprising fixing a support flange provided on a support part and a liquid supply pipe flange provided on the liquid supply pipe, the support part provided in the casing in advance and supporting, outside the casing, the liquid supply pipe inserted into the liquid injection path.

15. The method of modifying the centrifugal compressor according to claim 14, wherein, when the liquid supply pipe is inserted into the casing, the liquid supply pipe is inserted into the support part while the liquid supply pipe is guided by a liner that is disposed between the support flange and the liquid supply pipe flange.

16. The method of modifying the centrifugal compressor according to claim 13, further comprising forming a pressure relief groove that is recessed from a fastening surface between a cover and the diaphragm, on at least one of the cover and the diaphragm, the cover covering, from a front side, a concave part provided on the diaphragm, defining the chamber between the concave part and the cover, and being fastened to the diaphragm.

17. The method of modifying the centrifugal compressor according to claim 13, wherein a member provided with the injection portion is detachably attached to a chamber member defining the chamber.

* * * * *